US005710571A

United States Patent [19]

Kuo

[11] Patent Number: 5,710,571

[45] Date of Patent: Jan. 20, 1998

[54] NON-OVERLAPPED SCANNING FOR A LIQUID CRYSTAL DISPLAY

[75] Inventor: Fang-Chien Kuo, Hsinchu, Taiwan

[73] Assignee: Industrial Technology Research Institute, Hsinchu, Taiwan

[21] Appl. No.: 557,653

[22] Filed: Nov. 13, 1995

[51] Int. Cl.[6] ..... G09G 3/36

[52] U.S. Cl. ..... 345/94; 345/208

[58] Field of Search ..... 345/94, 98, 99, 345/100, 96, 97, 92, 86, 87, 88, 208, 209; 348/792, 793, 791, 790; 349/33, 34, 36

[56] References Cited

U.S. PATENT DOCUMENTS

| | | | |
|---|---|---|---|
| 4,816,819 | 3/1989 | Enari et al. | 340/811 |
| 4,917,468 | 4/1990 | Matsuhashi et al. | 350/332 |
| 5,040,874 | 8/1991 | Fukuda | 359/54 |
| 5,268,777 | 12/1993 | Sato | 359/57 |
| 5,274,484 | 12/1993 | Mochizuki et al. | 359/55 |
| 5,307,084 | 4/1994 | Yamaguchi et al. | 345/58 |
| 5,365,284 | 11/1994 | Matsumoto et al. | 345/99 |
| 5,412,397 | 5/1995 | Kanatani et al. | 345/100 |
| 5,579,027 | 11/1996 | Sakurai et al. | 345/100 |

OTHER PUBLICATIONS

"Parasitic Capacitance Compensation in TFT–LCDs for HDTV Projection" by M Adachi et al, SID '92 Digest, paper 41.2 pp. 785–788.

*Primary Examiner*—Xiao Wu

*Attorney, Agent, or Firm*—George O. Saile; Stephen B. Ackerman; Larry J. Prescott

[57] ABSTRACT

This invention provides a method for scanning a thin film transistor liquid crystal display which eliminates the undesirable brightness fluctuations in the display due to parasitic capacitance. When conventional scanning methods are used in thin film transistor liquid crystal displays parasitic capacitance between the gate of the thin film transistors and the pixels causes fluctuations in brightness of the pixels. This method scans only one row of the display at a time and the brightness fluctuations of the pixels are eliminated.

18 Claims, 6 Drawing Sheets

NON-OVERLAPPED SCANNING FOR A LIQUID CRYSTAL DISPLAY

BACKGROUND OF THE INVENTION

1. Field of the Invention

This invention relates to a thin film transistor liquid crystal display for a high density television system. Parasitic capacitance in the thin film transistor liquid crystal display causes brightness fluctuations in the display when scanned by conventional methods. This invention provides a method of scanning the display so that the fluctuations in brightness are eliminated.

2. Description of Related Art

When thin film transistor liquid crystal displays are scanned using the conventional means of scanning two rows at a time and scanning the display twice during each frame of the display image the pixels demonstrate an undesirable brightness fluctuation. This brightness fluctuation is caused by parasitic capacitance in the thin film transistor liquid crystal display. A paper "PARASITIC CAPACITANCE COMPENSATION IN TFT-LCDs FOR HDTV PROJECTION," by M. Adachi et al, SID 92 Digest, paper 41.2, pages 785–788 discusses the problem of parasitic capacitance and suggests a method of dealing with the problem by shrinking the pulse width of one of the two simultaneous scanning pulses.

U.S. Pat. No. 4,816,819 to Enari et al; U.S. Pat. No. 4,917,468 to Matsuhashi et al; U.S. Pat. No. 5,040,874 to Fukuda; U.S. Pat. No. 5,268,777 to Sato; U.S. Pat. No. 5,274,484 to Mochizuki et al; and U.S. Pat. No. 5,307,084 to Yamaguchi et al; all show driving apparatus for driving liquid crystal display panels but do not deal with the problem of brightness fluctuations.

SUMMARY OF THE INVENTION

It is a principle object of the invention to provide a means of driving a thin film transistor liquid crystal display so that the brightness difference in pixels caused by parasitic capacitance is eliminated.

It is a further object of this invention to provide a thin film transistor liquid crystal display wherein the brightness differences between pixels caused by parasitic capacitance is eliminated.

FIG. 1A shows an equivalent circuit diagram of a conventional thin film transistor liquid crystal display showing the N row by M column array of cells making up the display, where N and M are positive integers. FIG. 1B shows an equivalent circuit diagram of one of the cells making up the display. As shown in FIG. 1B, each cell has a thin film transistor 20 switching element connected to a pixel 22 represented by capacitors $C_{LC}$ 24 and $C_S$ 26. The row electrode 30 is connected to a row select line 31 which also connects the row electrodes for the remaining cells in the row. As shown in FIG. 1B, the row electrode is the gate of the thin film transistor. The column electrode 32 is connected to a column select line 33 which also connects the column electrodes for the remaining cells in the column. The column electrode is the source of the thin film transistor. The voltage level on row select line n, where n is a positive integer from 1 to N, is VG(n) and is set by the scan driver 34. The voltage level on column select line m, where m is a positive integer from 1 to M, is VD(m) and is set by the data driver 36. The row select line voltage, VG(n), is varied between $V_{GH}$ when the row is selected and $V_{GL}$ when the row is not selected.

FIG. 2 shows the conventional method for selecting the rows of cells in the display. As seen in FIG. 2, a voltage pulse of voltage level $V_{GH}$ 60 is applied to the row select lines two rows at a time and voltage level $V_{GL}$ 61 is applied to the remaining row select lines. Each row select line is selected once in one scanning cycle. This conventional method of scanning results in brightness differences between pixels caused by parasitic capacitance between the gate of the thin film transistor of a cell and the pixel of the cell in the same column and next row.

FIG. 3A shows an equivalent circuit diagram of four cells; cell A 43, cell B 44, cell C 45, and cell D 46; in one column and four consecutive rows of the display. The voltages applied to the row select lines of the four cells are VG(A), VG(B), VG(C), and VG(D). The voltages at the pixels of the four cells are $V_A$, $V_B$, $V_C$, and $V_D$. There is a parasitic capacitance between the gate and the drain of the thin film transistor of each cell, $C_{gd}$, and between the pixel of each cell and the gate of the thin film transistor of the cell in the same column and next row, $C_{gp}$. These parasitic capacitances are shown in FIG. 3A. There are also capacitances $C_S$ and $C_{LC}$ in each cell of the display as shown in FIG. 3A.

FIG. 3B shows the voltages, VG(A), VG(B), VG(C), and VG(D) applied to the four row select lines the cells A, B, C, and D shown in FIG. 3A for the conventional method of selecting the rows of cells in the display. The voltages at the pixels are given by $V_A$, $V_B$, $V_C$, and $V_D$. Cell A and cell B are selected first with voltage VG(A) and VG(B) driven to $V_{GH}$ 60 and VG(C) and VG(D) held at $V_{GL}$ 61. After the duration of the pulse width 50 VG(A) and VG(B) drop to $V_{GL}$ and VG(C) and VG(D) are driven to $V_{GH}$. At the time the voltages VG(A) and VG(B) drop to $V_{GL}$ the pixel voltage $V_A$ drops by an amount $V_I$ 41 and the pixel voltage $V_B$ drops by an amount $V_{II}$ 42, where $$V_I=(V_{GH}-V_{GL})\times(C_{gd}30\ C_{gp})/(C_{gd}+C_{gp}+C_{LC}+C_S) \text{ and}$$

$$V_{II}=(V_{GH}-V_{GL})\times C_{gd}/(C_{gd}+C_{gp}+C_{LC}+C_S).$$

After the duration of another pulse width 50 VG(C) and VG(D) drop to $V_{GL}$. At the time the voltages VG(C) and VG(D) drop to $V_{GL}$ the pixel voltage $V_C$ drops by an amount $V_I$ 41 and the pixel voltage $V_D$ drops by an amount $V_{II}$ 42 where again $$V_I=(V_{GH}-V_{GL})\times(C_{gd}+C_{gp})/(C_{gd}+C_{gp}+C_{LC}+C_S) \text{ and}$$

$$V_{II}=(V_{GH}-V_{GL})\times C_{gd}/(C_{gd}+C_{gp}+C_{LC}+C_S).$$

Voltage drop $V_I$ is greater than voltage drop $V_{II}$. This difference in pixel voltage drop causes brightness variations in thin film transistor liquid crystal displays using conventional methods of selecting the rows of the cells of the display. This difference in pixel voltage drop is caused by the parasitic capacitance, $C_{gp}$, between the gate of the thin film transistor of the selected cell and the pixel of the cell in the next row of the same column.

The objectives of this invention are achieved by using a method for selecting the rows of the cells of the display whereby the voltage level $V_{GH}$ is applied to only one row select line and voltage level $V_{GL}$ is applied to the remaining N−1 row select lines during the interval of each pulse width. The drop in pixel voltage described in the previous paragraph will then be $V_{II}$ for all the pixels in the display and the brightness variation will be eliminated.

DESCRIPTION OF THE PREFERRED EMBODIMENTS

Figure 1A:
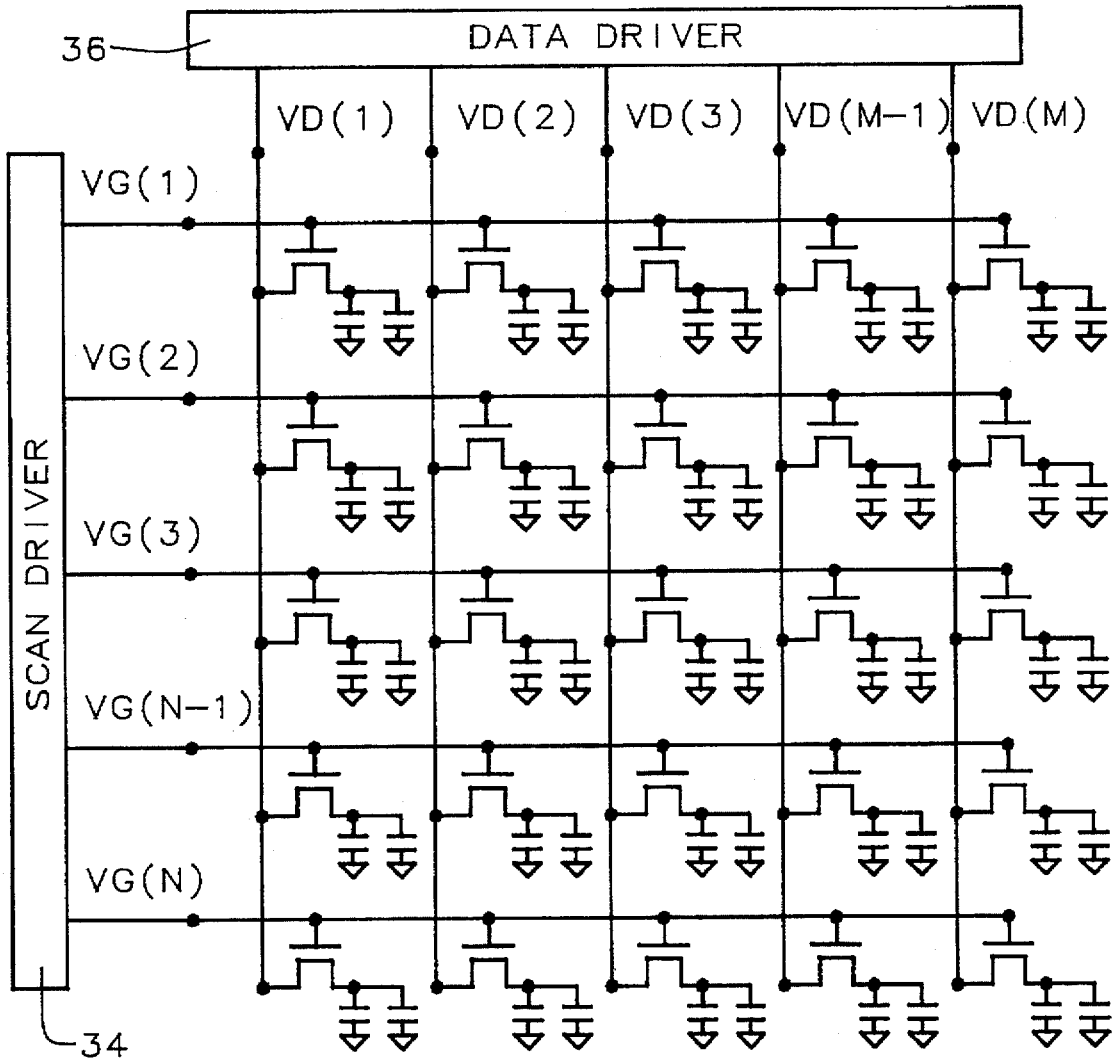
FIG. 1A PRIOR ART
FIG. 1A is an equivalent circuit diagram of the thin film transistor liquid crystal display.
Figure 1B:
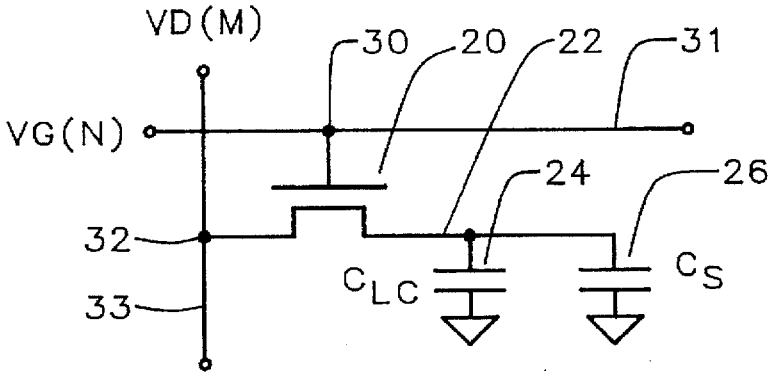
FIG. 1B PRIOR ART
FIG. 1B is an equivalent circuit diagram of one of the cells of the thin film transistor liquid crystal display.
Figure 2:
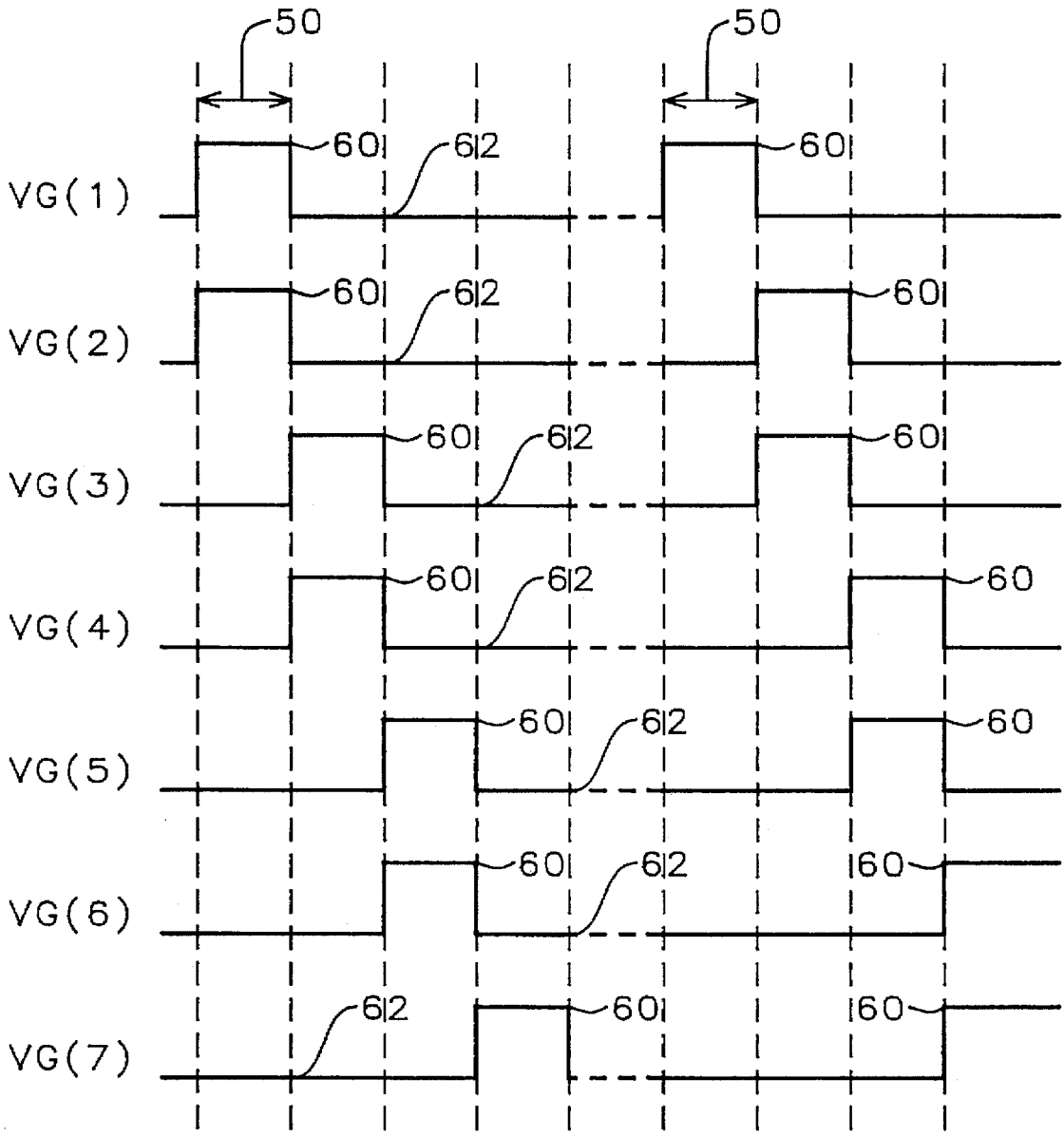
FIG. 2 PRIOR ART
FIG. 2 is a diagram of the conventional pulse train sequence used to drive the row select lines of the thin film transistor liquid crystal display.
Figure 3A:
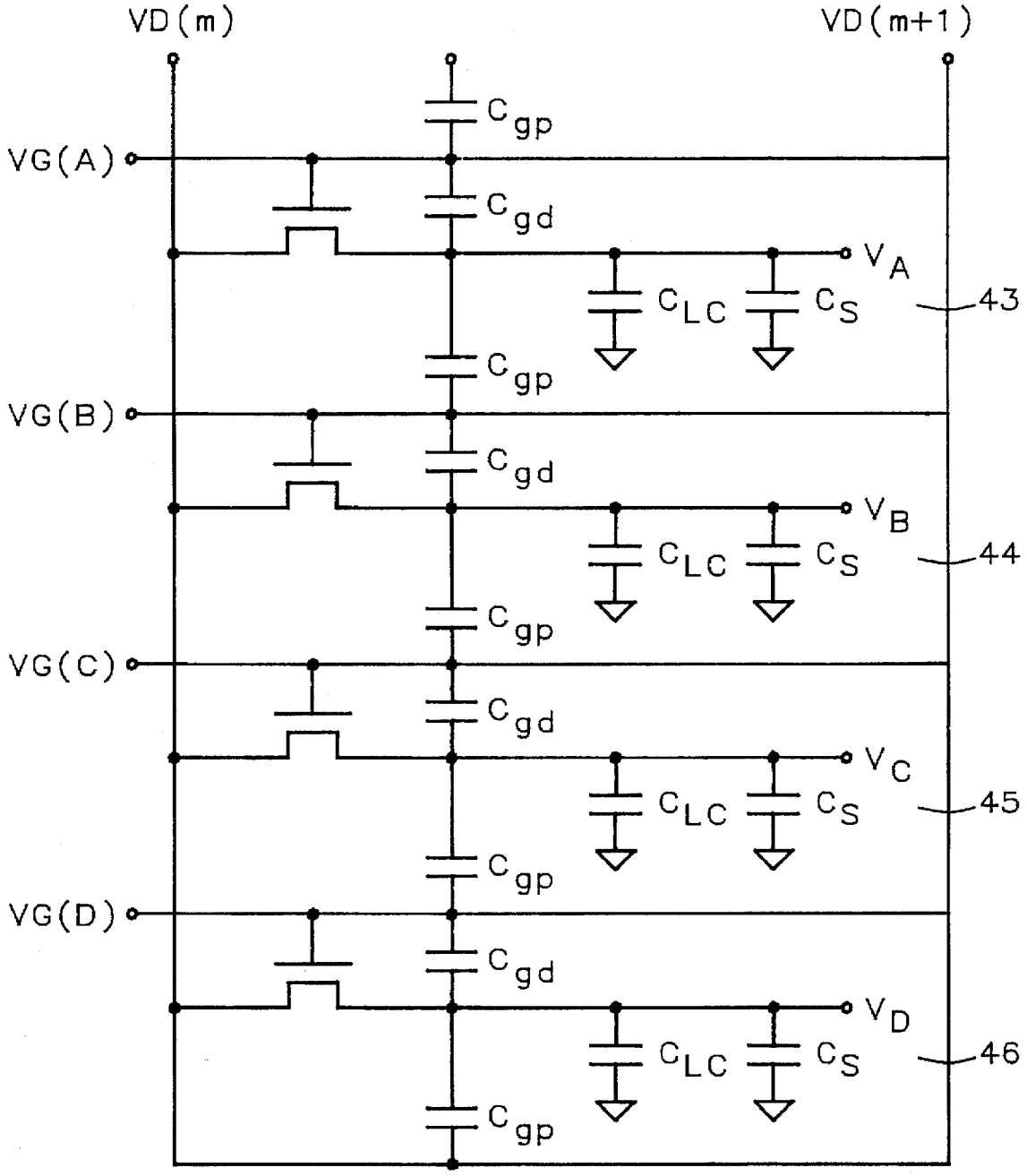
FIG. 3A PRIOR ART
FIG. 3A is an equivalent circuit diagram of the cells in four consecutive rows of one column of the thin film transistor liquid crystal display.
Figure 3B:
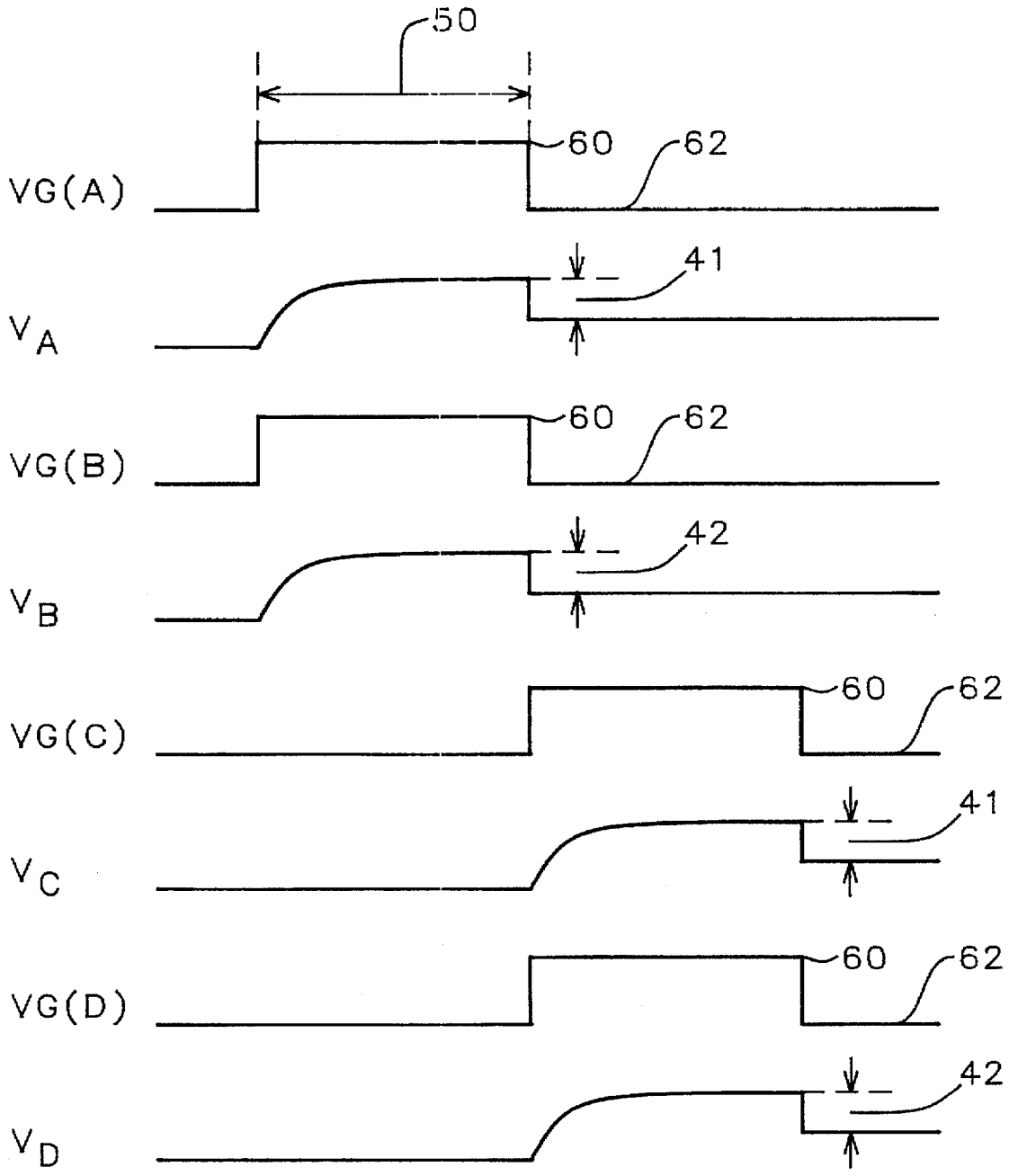
FIG. 3B PRIOR ART
FIG. 3B is a diagram of the conventional pulse train sequence used to drive the row select lines of the cells in four consecutive rows of one column of the thin film transistor liquid crystal display.

Refer now to FIG. 1A, FIG. 1B and FIG. 4 through FIG. 6B, there is shown a thin film transistor liquid crystal display and a method for driving the thin film transistor liquid crystal display. FIG. 1A shows an equivalent circuit diagram of the N row by M column array of cells making up the display, where N is a positive integer such as 480 and M is a positive integer such as 640. FIG. 1B shows an equivalent circuit diagram of one of the cells making up the display. As shown in FIG. 1B, each cell has a thin film transistor 20 switching element connected to a pixel 22 represented by capacitors $C_{LC}$ 24 and $C_S$ 26. The row electrode 30 is connected to a row select line 31 which also connects the row electrodes for the remaining cells in the row. As shown in FIG. 1B, the row electrode is the gate of the thin film transistor. The column electrode 32 is connected to a column select line 33 which also connects the column electrodes for the remaining cells in the column. The column electrode is the source of the thin film transistor. The voltage level on row select line n, where n is a positive integer from 1 to N, is VG(n) and is set by the scan driver 34. The voltage level on column select line m, where m is a positive integer from 1 to M, is VD(m) and is set by the data driver 36.

The row select line voltage, VG(n), is varied between $V_{GH}$ when the row is selected and $V_{GL}$ when the row is not selected. $V_{GH}$ is between about 3 and 16 volts and $V_{GL}$ is between about −10 and −6 volts. In order to eliminate intensity fluctuation between adjacent pixels $V_{GH}$ is not applied to two adjacent row select lines simultaneously.

Figure 4:
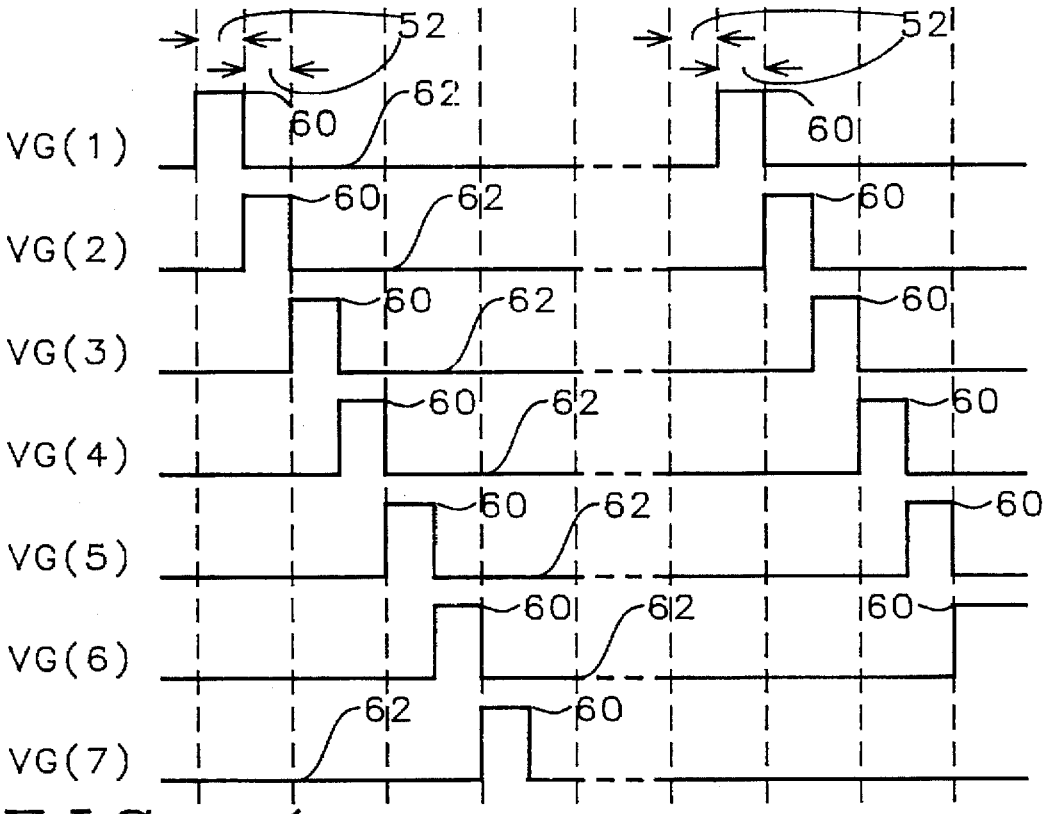
FIG. 4 is a diagram of a pulse train of this invention used to drive the row select lines of the thin film transistor liquid crystal display.

An embodiment of a method for driving the thin film transistor liquid crystal display is shown in FIG. 4. The 480 row select lines are driven by 480 periodic voltage pulse trains each voltage pulse train having a scanning frequency of 60 scans per second and a scanning period of period of 0.01667 seconds. Each scanning period is divided into an odd field making up the first half of the scanning period and an even field making up the second half of the scanning period. The voltage pulses have a voltage level 60 of, for example, 14 volts during the interval the row is selected and a voltage level 62 of, for example, −7 volts when the row is not selected. The pulse width 52 of the selecting voltage pulse is slightly less than about 17.3 microseconds. As shown in FIG. 4, the selecting voltage pulses 60 are applied sequentially to row select lines 1, 2, 3, 4, 5, . . . , 478, 479, and 480 in the odd field and no selection, 1, 2, 3, 4, 5, . . . , 478, and 479 in the even field. Referring to FIG. 4, in the odd field row select lines 1 and 2, 3 and 4, 5 and 6, . . . , 477 and 478, and 479 and 480 have the same video data signal. In the even field there is a one line offset and row select line 1, row select lines 2 and 3, 4 and 5, 6 and 7, . . . , 476 and 477, and 478 and 479 have the same video data signal. Row select line 480 is displayed only in the odd field. The selecting voltage pulse 60 is applied to row select lines 1 through 479 twice and to row select line 480 once during each scanning period.

Figure 5:
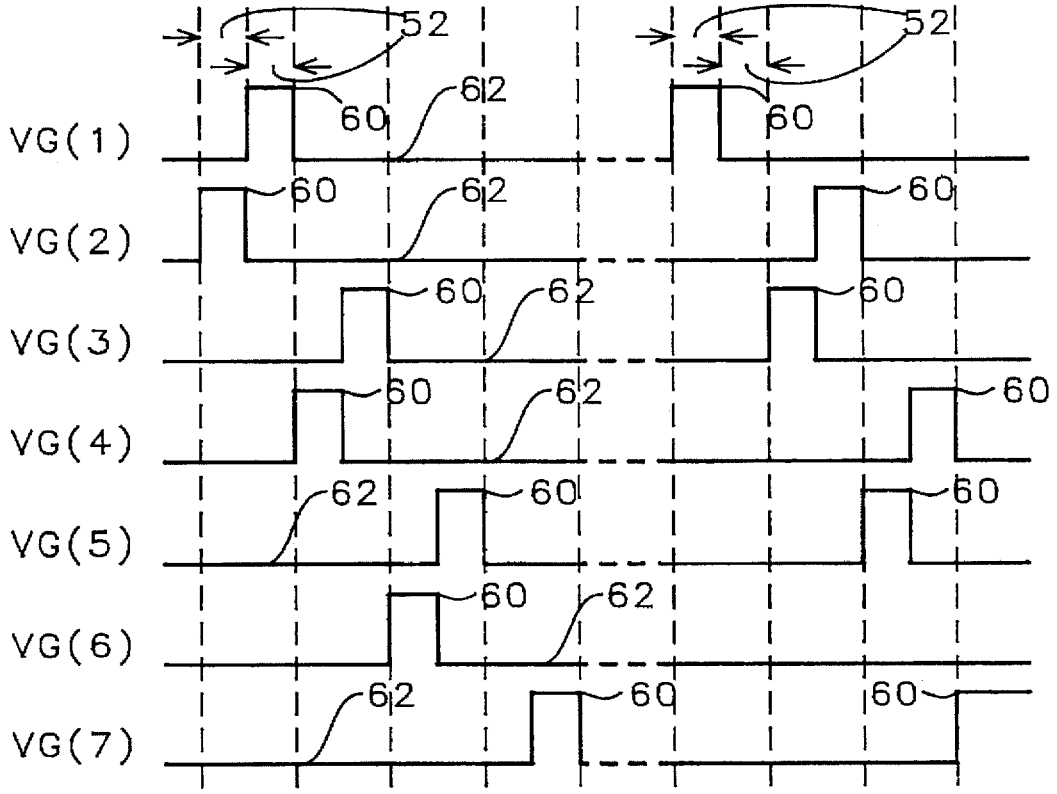
FIG. 5 is a diagram of a pulse train of this invention used to drive the row select lines of the thin film transistor liquid crystal display.

Another embodiment of a method for driving the thin film transistor liquid crystal display is shown in FIG. 5. The 480 row select lines are driven by 480 periodic voltage pulse trains each voltage pulse train having a scanning frequency of 60 scans per second and a scanning period of period of 0.01667 seconds. Each scanning period is divided into an odd field making up the first half of the scanning period and an even field making up the second half of the scanning period. The voltage pulses have a voltage level 60 of, for example, 14 volts during the interval the row is selected and a voltage level 62 of, for example, −7 volts when the row is not selected. The pulse width 52 of the selecting voltage pulse is slightly less than about 17.3 microseconds. As shown in FIG. 5 the selecting voltage pulses 60 are applied sequentially to row select lines 2, 1, 4, 3, 6, 5, 8, 7, . . . , 476, 475, 478, 477, 480, and 479 in the odd field and 1, no selection, 3, 2, 5, 4, 7, 6, . . . , 475, 474, 477, 476, 479, and 478 in the even field. Referring to FIG. 5, in the odd field row select lines 2 and 1, 4 and 3, 6 and 5, . . . , 476 and 475, 478 and 477, and 480 and 479 have the same video data signal. In the even field there is a one line offset and row select line 1, row select lines 2 and 3, 4 and 5, 6 and 7, . . . , 476 and 477, and 478 and 479 have the same video data signal. Row select line 480 is displayed only in the odd field. The selecting voltage pulse 60 is applied row select lines 1 through 479 twice and to row select line 480 once during each scanning period.

Figure 6A:
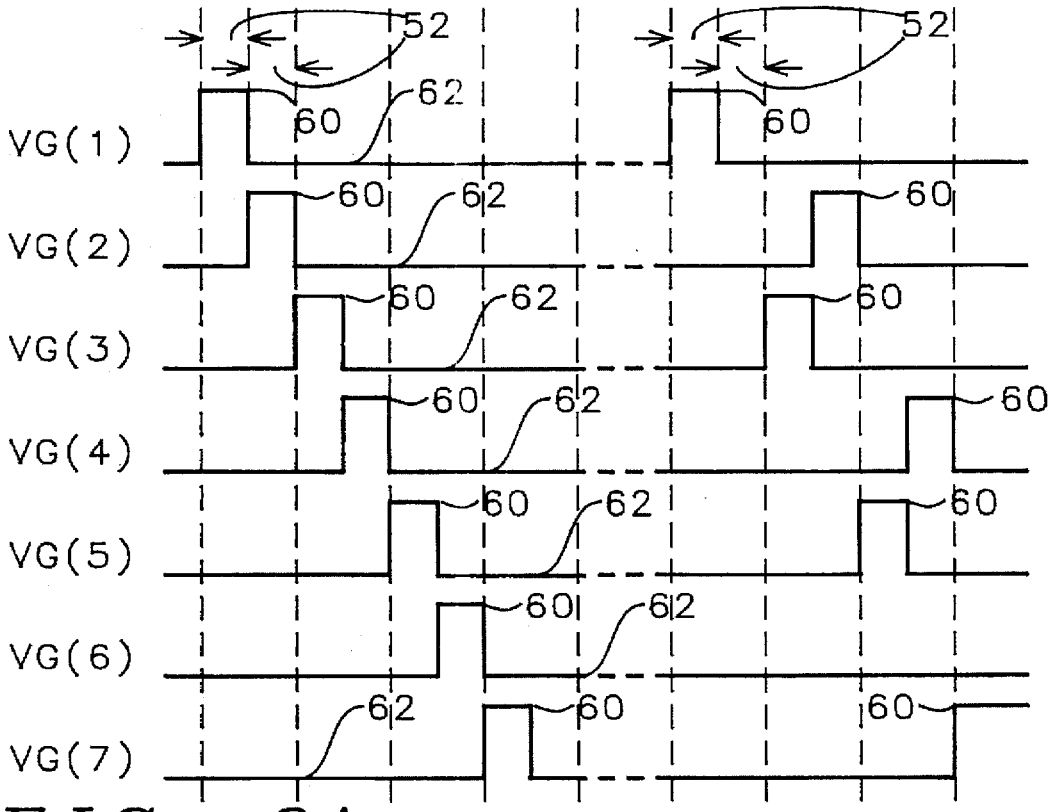
FIG. 6A is a diagram of a pulse train of this invention used to drive the row select lines of the thin film transistor liquid crystal display.

Another embodiment of a method for driving the thin film transistor liquid crystal display is shown in FIG. 6A. The 480 row select lines are driven by 480 periodic voltage pulse trains each voltage pulse train having a scanning frequency of 60 scans per second and a scanning period of period of 0.01667 seconds. Each scanning period is divided into an odd field making up the first half of the scanning period and an even field making up the second half of the scanning period. The voltage pulses have a voltage level 60 of, for example, 14 volts during the interval the row is selected and a voltage level 62 of, for example, −7 volts when the row is not selected. The pulse width 52 of the selecting voltage pulse is slightly less than about 17.3 microseconds. As shown in FIG. 6A the selecting voltage pulses 60 are applied sequentially to row select lines 1, 2, 3, 4, 5, . . . , 478, 479, and 480 in the odd field and 1, no selection, 3, 2, 5, 4, 7, 6, . . . , 475, 474, 477, 476, 479, and 478 in the even field. Referring to FIG. 6A, in the odd field row select lines 1 and 2, 3 and 4, 5 and 6, . . . , 477 and 478, and 479 and 480 have the same video data signal. In the even field there is a one line offset and row select line 1, row select lines 2 and 3, 4 and 5, 6 and 7, . . . , 476 and 477, and 478 and 479 have the same video data signal. Row select line 480 is displayed only in the odd field. The selecting voltage pulse 60 is applied to row select lines 1 through 479 twice and to row select line 480 once during each scanning period.

Figure 6B:
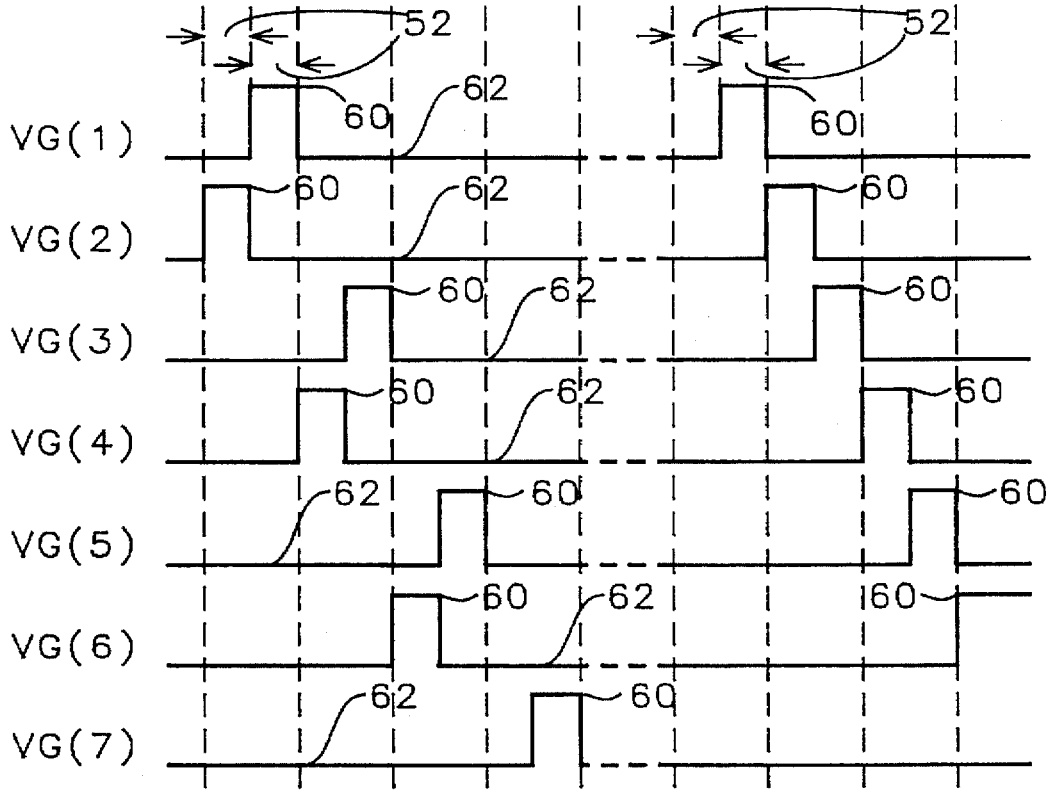
FIG. 6B is a diagram of a pulse train of this invention used to drive the row select lines of the thin film transistor liquid crystal display.

Another embodiment of a method for driving the thin film transistor liquid crystal display is shown in FIG. 6B. The 480 row select lines are driven by 480 periodic voltage pulse trains each voltage pulse train having a scanning frequency of 60 scans per second and a scanning period of period of 0.01667 seconds. Each scanning period is divided into an odd field making up the first half of the scanning period and an even field making up the second half of the scanning period. The voltage pulses have a voltage level 60 of, for example, 14 volts during the interval the row is selected and a voltage level 62 of, for example, −7 volts when the row is not selected. The pulse width 52 of the selecting voltage pulse is slightly less than about 17.3 microseconds. As shown in FIG. 6B the selecting voltage pulses 60 are applied sequentially to row select lines 2, 1, 4, 3, 6, 5, . . . , 476, 475, 478, 477, 480, and 479 in the odd field and no selection, 1, 2, 3, 4, 5, 6, . . . , 474, 475, 476, 477, 478, and 479 in the even field. Referring to FIG. 6B, in the odd field row select lines 1 and 2, 3 and 4, 5 and 6, . . . , 475 and 476, 477 and 478, and 479 and 480 have the same video data signal. In the even field there is a one line offset and row select line 1, row select lines 2 and 3, 4 and 5, 6 and 7, . . . , 474 and 475, 476 and 477, and 478 and 479 have the same video data signal. Row select line 480 is displayed only in the odd field. The selecting voltage pulse 60 is applied to row select line 1 through 479 twice and to row select line 480 once during each scanning period.

While the invention has been particularly shown and described with reference to the preferred embodiments thereof, it will be understood by those skilled in the art that various changes in form and details may be made without departing from the spirit and scope of the invention.

What is claimed is:

1. A method of driving a thin film transistor liquid crystal display, comprising the steps of:

providing a thin film transistor liquid crystal display having a matrix array of cells formed in N rows by M columns, where N is an even positive integer and M is a positive integer, wherein each cell comprises a pixel connected to a switching element, each said switching element having a row electrode and a column electrode wherein each cell is selected by applying a selecting voltage to said row electrode or not selected by applying a non selecting voltage to said row electrode;

connecting said row electrodes in each of said N rows of cells to a row select line thereby forming row select lines 1 through N;

connecting said column electrodes being in each of said M columns of cells to a column select line thereby forming column select lines 1 through M;

providing means for selecting rows 1 through N of said cells using N periodic voltages applied to said N row select lines wherein each of said N periodic voltages has a scanning period made up of an odd field followed by an even field, has a voltage level of either said selecting voltage or said non selecting voltage, said means for selecting rows 1 through N comprises sequentially applying said selecting voltage level to said row select lines 2, 1, 4, 3, 6, 5, 8, 7, . . . , N-4, N-5, N-2, N-3, N and N-1 in said odd field of said scanning period or selectively applying said selecting voltage level to row select line 1, no said row select line, said row select lines 3, 2, 5, 4, 7, 6, . . . , N-5, N-6, N-3, N-4, N-1, and N-2 in said even field of said scanning period, and no more than one of said N periodic voltages is said selecting voltage at any one time;

providing video signals 1 through M; and applying said video signals 1 through M to said column select lines 1 through M.

2. The method of claim 1 wherein said switching element is a thin film transistor.

3. The method of claim 2 wherein said row electrode is the gate of said thin film transistor.

4. The method of claim 2 wherein said column electrode is the source of said thin film transistor.

5. The method of claim 2 wherein each said pixel is connected to the drain of said thin film transistor.

6. The method of claim 1 wherein said means for selecting rows 1 through N comprises sequentially applying said selecting voltage level to said row select lines 2, 1, 4, 3, 6, 5, 8, 7, . . . , N-4, N-5, N-2, N-3, N and N-1 in said odd field of said scanning period and to row select line 1, no said row select line, said row select lines 3, 2, 5, 4, 7, 6, . . . , N-5, N-6, N-3, N-4, N-1, and N-2 in said even field of said scanning period.

7. The method of claim 1 wherein said means for selecting rows 1 through N comprises sequentially applying said selecting voltage level to said row select lines 1, 2, 3, 4, 5, . . . , N-2, N-1, and N in said odd field of said scanning period and to row select line 1, no said row select line, said row select lines 3, 2, 5, 4, 7, 6, . . . , N-5, N-6, N-3, N-4, N-1, and N-2 in said even field of said scanning period.

8. The method of claim 1 wherein said means for selecting rows 1 through N comprises sequentially applying said selecting voltage level to said row select lines 2, 1, 4, 3, 6, 5, 8, 7, . . . , N-4, N-5, N-2, N-3, N and N-1 in said odd field of said scanning period and to no said row select line, said row select lines 1, 2, 3, 4, 5, . . . , N-2, and N-1 in said even field of said scanning period.

9. The method of claim 1 wherein said positive integer N is 480.

10. A liquid crystal display, comprising:

a thin film transistor liquid crystal display having a matrix array of cells formed in N rows by M columns, where N is an even positive integer and M is a positive integer, wherein each cell comprises a pixel connected to a switching element, each said switching element having a row electrode and a column electrode wherein each cell is selected by applying a selecting voltage to said row electrode or not selected by applying a non selecting voltage to said row electrode;

row select lines 1 through N wherein each of said row select lines is connected to said row electrodes in one of said N rows of cells;

column select lines 1 through M wherein each of said column select lines is connected to said column electrodes in each of said M columns of cells;

means for selecting rows 1 through N of said cells using N periodic voltages applied to said N row select lines wherein each of said N periodic voltages has a scanning period made up of an odd field followed by an even field, has a voltage level of either said selecting voltage or said non selecting voltage, said means for selecting rows 1 through N comprises sequentially applying said selecting voltage level to said row select lines 2, 1, 4, 3, 6, 5, 8, 7, . . . , N-4, N-5, N-2, N-3, N and N-1 in said odd field of said scanning period or sequentially applying said selecting voltage level to row select line 1, no said row select line, said row select lines 3, 2, 5, 4, 7, 6, . . . , N-5, N-6, N-3, N-4, N-1, and N-2 in said even field of said scanning period, and no more than one of said N periodic voltages is said selecting voltage at any one time;

video signals 1 through M; and means for applying said video signals 1 through M to said column select lines 1 through M.

11. The liquid crystal display of claim 10 wherein said switching element is a thin film transistor.

12. The liquid crystal display of claim 11 wherein said row electrode is the gate of said thin film transistor.

13. The liquid crystal display of claim 11 wherein said column electrode is the source of said thin film transistor.

14. The liquid crystal display of claim 11 wherein each said pixel is connected to the drain of said thin film transistor.

15. The liquid crystal display of claim 10 wherein said means for selecting rows 1 through N comprises sequentially applying said selecting voltage level to said row select lines 2, 1, 4, 3, 6, 5, 8, 7, . . . , N-4, N-5, N-2, N-3, N and N-1 in said odd field of said scanning period and to row select line 1, no said row select line, said row select lines 3, 2, 5, 4, 7, 6, . . . , N-5, N-6, N-3, N-4, N-1, and N-2 in said even field of said scanning period.

16. The liquid crystal display of claim 10 wherein said means for selecting rows 1 through N comprises sequentially applying said selecting voltage level to said row select lines 1, 2, 3, 4, 5, . . . , N-2, N-1, and N in said odd field of said scanning period and to row select line 1, no said row select line, said row select lines 3, 2, 5, 4, 7, 6, . . . , N-5, N-6, N-3, N-4, N-1, and N-2 in said even field of said scanning period.

17. The liquid crystal display of claim 10 wherein said means for selecting rows 1 through N comprises sequentially applying said selecting voltage level to said row select lines 2, 1, 4, 3, 6, 5, 8, 7, . . . , N-4, N-5, N-2, N-3, N and N-1 in said odd field of said scanning period and to no said row select line, said row select lines 1, 2, 3, 4, 5, . . . , N-2, and N-1 in said even field of said scanning period.

18. The liquid crystal display of claim 10 wherein said positive integer N is 480.

* * * * *